United States Patent [19]

Welch

[11] Patent Number: 4,715,081

[45] Date of Patent: Dec. 29, 1987

[54] DUST MOP WITH IMPROVED BACKING FOR SLIP-THROUGH FRAME

[76] Inventor: Deo Welch, P.O. Box 1251, Longview, Tex. 75606

[21] Appl. No.: 322,534

[22] Filed: Nov. 18, 1981

[51] Int. Cl.[3] ..... A47L 13/24

[52] U.S. Cl. ..... 15/229.8

[58] Field of Search ..... 15/228, 229 R, 229 A, 15/229 AC, 229 AP, 229 AW, 229 B, 229 BC, 229 BP, 229 BW

[56] References Cited

FOREIGN PATENT DOCUMENTS 1262201 4/1961 France ..... 15/229 BP

*Primary Examiner*—Edward L. Roberts

[57] ABSTRACT

The backing for the dust mop has a relatively long pocket extending from one end of the dust mop for a substantial portion of the length thereof, terminating a short distance from the other end and being open at such other end for insertion of a slip-through frame therein. Extending from the other end of the backing is a much shorter end pocket having an open inner end which overlies the open inner end of the longer pocket. This has the advantage that when the slip-through frame is fully received within the backing and the shorter pocket is pulled over the adjacent end of the frame and into overlying relation with the open end of the larger pocket, the frame cannot very easily slip out of the backing by mistake.

6 Claims, 4 Drawing Figures

DUST MOP WITH IMPROVED BACKING FOR SLIP-THROUGH FRAME

BACKGROUND OF THE INVENTION

The present invention relates generally as indicated to a dust mop with improved backing for a slip-through type frame.

A standard backing for a dust mop for receiving a slip-through type frame has a long pocket extending from one end and open at the other end and a shorter pocket extending from the other end beneath the open end of the longer pocket. One end of the slip-through frame is slid all the way into the longer pocket through the open end thereof, following which the other end of the frame is inserted into the open end of the shorter pocket which underlies the longer pocket. One objection to this type of backing is that during use the frame can easily slip out of the shorter pocket by mistake.

SUMMARY OF THE INVENTION

With the foregoing in mind, it is a principal object of this invention to provide a dust mop with a backing for a slip-through type frame which substantially eliminates the problem of the frame slipping out of the backing by mistake during use of the mop.

These and other objects of the present invention may be achieved by providing the backing with a relatively long pocket extending from one end of the dust mop for a substantial portion of the length thereof, terminating a short distance from the other end and being open at such other end for insertion of a slip-through frame therein, and a much shorter end pocket extending from the other end and having an open end which overlies the open end of the longer pocket. Such a backing construction has the advantage that when the slip-through frame is inserted into the longer pocket and the shorter pocket is pulled over the adjacent end of the frame, the shorter pocket overlies the open end of the longer pocket, thus preventing the frame from accidentally slipping out of the backing by mistake.

To the accomplishment of the foregoing and related ends the invention, then, comprises the features hereinafter fully described and particularly pointed out in the claims, the following description and the annexed drawing setting forth in detail a certain illustrative embodiment of the invention, this being indicative, however, of but one of the various ways in which the principles of the invention may be employed.

DESCRIPTION OF THE PREFERRED EMBODIMENT

Figure 1:
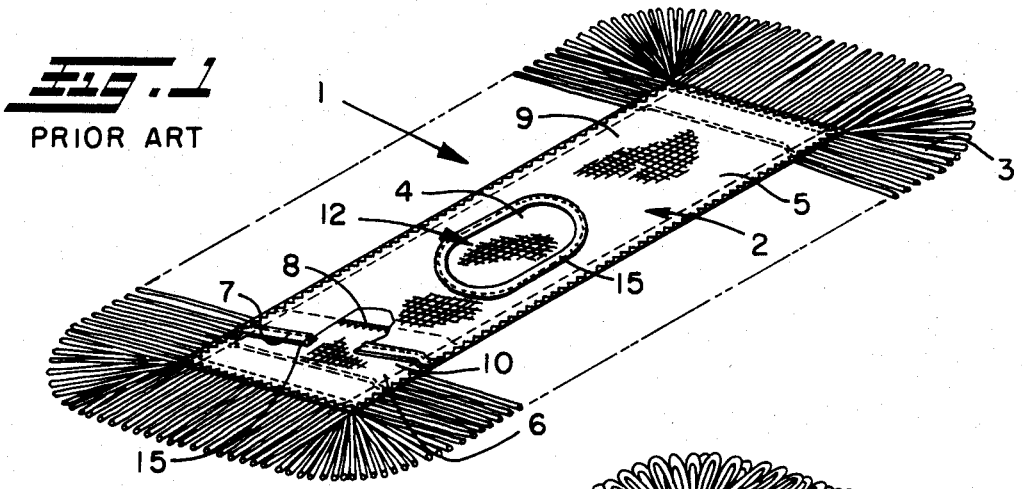
Fig. 1 PRIOR ART
FIG. 1 is a perspective view of a dust mop having a conventional backing for a slip-through type of frame.

Referring now in detail to the drawing, and initially to FIG. 1 thereof, there is shown a conventional form of dust mop 1 including a standard type backing 2 for receipt of a slip-through frame. The front or downwardly facing side of the backing has yarns or yarn-like material 3 secured thereto as by stitching or tufting. The term "yarns" as used herein is a generic term which covers all yarn and cord-like materials suitable for use in a dust mop.

Attached to the other or back side 4 of the backing 2 are a pair of oppositely facing pockets 5 and 6 formed as by stitching a single piece of fabric material to the backing across each end thereof and along the sides, leaving the inner ends 7 and 8 of each fabric piece 9 and 10 open. One of the pockets 5 is much longer than the other, and extends for a substantial portion of the length of the backing, with the open end 7 thereof overlying the open end 8 of the shorter pocket 6 as shown. The longer pocket also desirably includes an oval shape center opening 12 therein through which the center frame bar of a conventional slip-through type frame will be exposed to permit attachment of a handle hinged thereto. The open ends of the pockets and oval opening 12 may be serged with thread to give them added strength, and reinforcing tape 15 may also be stitched to one or both such open ends and around the oval opening 12 as shown.

To assemble a slip-through frame within the backing 2, one end of the slip-through frame is inserted all the way into the longer pocket 5 through the open end 7 thereof, after which the other end of the frame may be slid back into the open end of the shorter pocket 6 which lies beneath the open end of the larger pocket 5 as shown in FIG. 1.

The length of the shorter pocket 6 may vary somewhat, but such shorter pocket is preferably only two to three inches deep on average or otherwise it may be difficult to insert the other end of the frame into the open end of the shorter pocket after the frame has been inserted into the longer pocket as aforesaid. Also, the open end of the shorter pocket may be cut on a diagonal so that the length of the shorter pocket along one side is less than along the other as shown to facilitate insertion of the adjacent end of the slip-through frame therein and also help retain such end within the shorter pocket. Nevertheless, it has been found that with this type of backing arrangement, the frame member still can fairly easily slip out of the shorter pocket by mistake during use.

Figure 2:
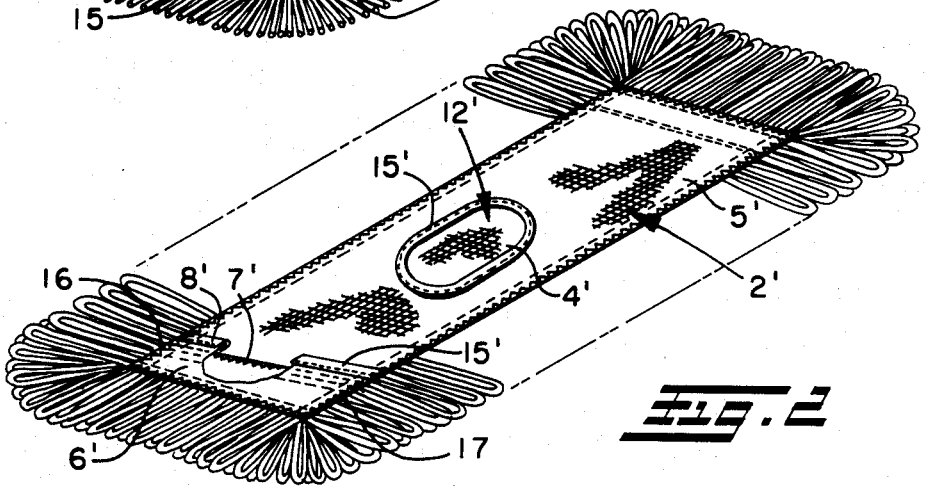
FIG. 2 is a perspective view of a dust mop similar to FIG. 1, but including an improved backing in accordance with the present invention for a slip-through type frame.

To reduce greatly the ease with which the frame member can slip out of the backing, the open end 8′ of the shorter pocket 6′ for the backing 2′ of the present invention, rather than underlying the open end 7′ of the longer pocket 5′, overlies the same as shown in FIG. 2. Although the extent of overlap of the shorter pocket 6′ relative to the longer pocket 5′ may vary somewhat, in the preferred form of the invention shown herein, such overlap is approximately ¾ inch. Also, the depth of the shorter pocket may vary somewhat, but is preferably only two to three inches deep on average or otherwise it may be difficult to pull the open end of the shorter pocket over the adjacent end of the slip-through frame after the frame has been inserted into the longer pocket as described hereafter.

Also, the open end 8′ of the shorter pocket 6′ is preferably cut on a diagonal so that the length of the shorter pocket along one side is less than along the other as shown to facilitate insertion of one end of the slip-through frame therein and also help retain such end within the shorter pocket. In the preferred form of dust mop shown, the shorter pocket has a depth of approximately two inches adjacent the shorter side 16 and a depth of approximately three inches adjacent the longer side 17.

The open end 7′ of the longer pocket 5′ also desirably extends diagonally across the backing at the same angle as the open end 8′ of the shorter pocket 6′ and underneath the open end of the shorter pocket a short distance, for example, ¾ inch as aforesaid. Otherwise, the details of construction of the dust mop 1′ of FIG. 2 may be substantially the same as the conventional dust mop shown in FIG. 1, and the same reference numerals followed by a prime symbol (′) are used to designate similar parts.

Figure 3:
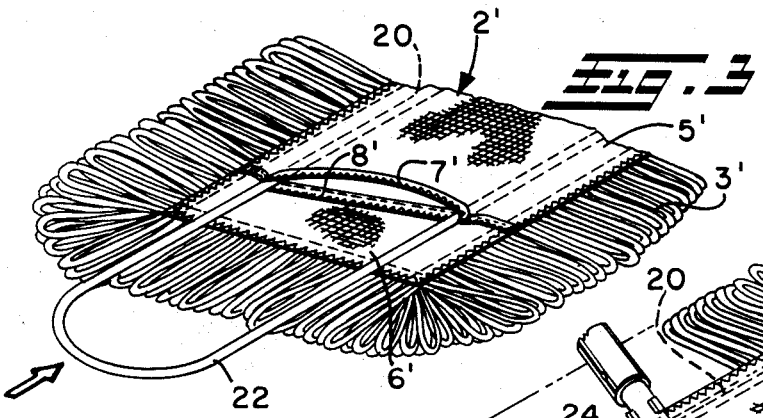
FIG. 3 is a partial perspective view of the left end of the mop of FIG. 2, showing a slip-through frame being inserted into the backing.
Figure 4:
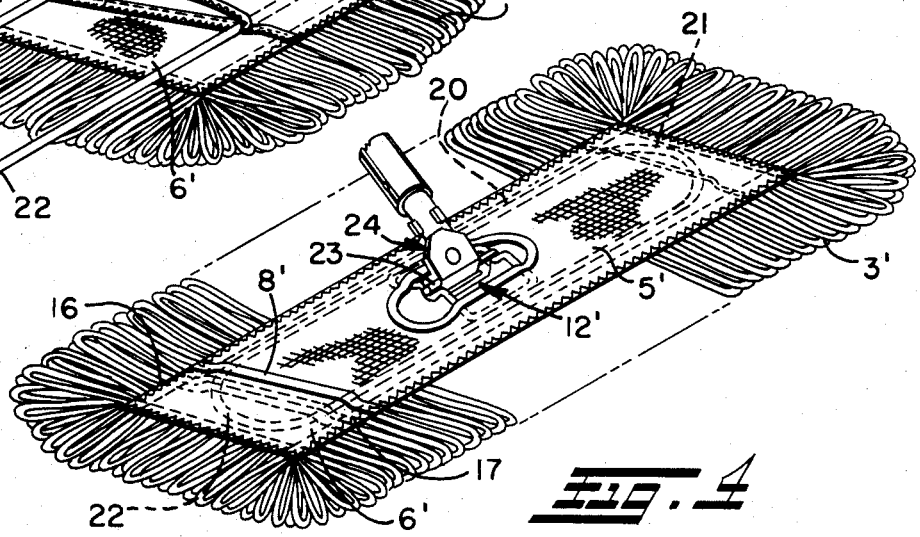
FIG. 4 is a perspective view of such dust mop similar to FIG. 2, but showing the slip-through frame fully received within the backing.

To assemble the slip-through frame 20 within the dust mop 1′ of FIG. 2, the open end 7′ of the longer pocket 5′ must first be pulled out from underneath the open end 8′ of the shorter pocket 6′ to permit insertion of one end 21 of the slip-through frame into the longer pocket as shown in FIG. 3. After the frame 20 is inserted all the way into the longer pocket, the open end 8′ of the shorter pocket 6′ is pulled over the adjacent end 22 of the frame and over the open end 7′ of the longer pocket 5′ as shown in FIG. 4. By having the open end of the shorter pocket overlie the open end of the longer pocket, the frame cannot nearly as easily slip out of the shorter pocket by mistake as it can when the shorter pocket underlies the longer pocket as shown in FIG. 1. When thus assembled, the center frame bar 23 of the slip-through frame 20 will be exposed through the oval opening 12′ in the larger pocket 5′ to permit attachment of a handle hinge 24 thereto as further shown in FIG. 4.

Although different types of materials may be used for the backing and pockets, a highly wear-resistant material such as nylon is preferably used.

From the foregoing, it will be apparent that the backing for the dust mop of the present invention provides a very simple and effective means for preventing a slip-through type frame from accidentally slipping out of the backing by mistake.

Although the invention has been shown and described with respect to a certain preferred embodiment, it is obvious that equivalent alterations and modifications will occur to others skilled in the art upon the reading and understanding of the specification. The present invention includes all such equivalent alterations and modifications and is limited only by the scope of the claims.

The embodiments of the invention in which an exclusive property or privilege is claimed are defined as follows:

1. A dust mop comprising a backing having a plurality of yarns secured to one side thereof, the other side of said backing having a pair of oppositely facing pockets extending from the opposite ends of said backing, one of said pockets being substantially longer than the other pocket, said pockets being open at their innermost ends, the open end of the shorter of said pockets overlying the open end of said larger pocket.

2. The dust mop of claim 1 wherein the open end of said shorter pocket extends inwardly beyond the open end of said larger pocket approximately ¾ inch.

3. The dust mop of claim 1 further comprising an opening in said larger pocket adjacent the approximate longitudinal center of said backing to permit attachment of a handle to a slip-through type frame when assembled within said backing.

4. The dust mop of claim 1 wherein the open ends of said pockets extend across said backing on a diagonal.

5. The dust mop of claim 4 wherein said shorter pocket has a depth of approximately two inches along the shorter side thereof and a depth of approximately three inches along the longer side thereof.

6. The dust mop of claim 1 wherein reinforcing means is applied to the open end of said shorter pocket.

* * * * *